US006455845B1

(12) United States Patent
Li et al.

(10) Patent No.: US 6,455,845 B1
(45) Date of Patent: Sep. 24, 2002

(54) ION PACKET GENERATION FOR MASS SPECTROMETER

(75) Inventors: Ganggiang Li, Palo Alto; Carl A. Myerholtz, Cupertino; George Yefchak, Santa Clara, all of CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/552,959

(22) Filed: Apr. 20, 2000

(51) Int. Cl.[7] ..... H01J 49/40
(52) U.S. Cl. ..... 250/287; 250/286
(58) Field of Search ..... 250/287, 286

(56) References Cited

U.S. PATENT DOCUMENTS

| | | | | |
|---|---|---|---|---|
| 5,689,111 A | | 11/1997 | Dresch et al. | 250/287 |
| 6,107,625 A | * | 8/2000 | Park | 250/287 |
| 6,285,027 B1 | * | 9/2001 | Chernushevich et al. | 250/287 |
| 6,300,626 B1 | * | 10/2001 | Brock et al. | 250/287 |

* cited by examiner

*Primary Examiner*—Kiet T. Nguyen

(57) ABSTRACT

A method of providing an ion packet to an analyzer section of a mass spectrometer from an ion beam, a pulser which can execute such a method, and a mass spectrometer which includes such a pulser. In the method, a field pulse is applied to extract an ion packet from the beam at a sideways direction to the beam and provide it to a mass analyzer section of the mass spectrometer, which pulse simultaneously causes non-extracted ions of the beam to be deflected onto an electrode of opposite charge. The pulse ON time is significantly longer than conventionally used. For example, the pulse ON time may be longer than the pulse OFF time or at least twice as long as or several times longer than required to extract the ion packet and provide it to the mass analyzer section, so as to reduce stray ions entering the mass analyzer section. Preferably, the pulse ON time is the time required for ions of a predetermined highest mass of interest to be analyzed by the analyzer section, minus the time required to refill the region of the beam from which the ion packet is extracted with ions of the predetermined highest mass. Ion leakage into the mass spectrometer section between packet extractions, and hence detected noise, can be reduced.

23 Claims, 6 Drawing Sheets

ION PACKET GENERATION FOR MASS SPECTROMETER

FIELD OF THE INVENTION

This invention relates mass spectrometry and an in particular to a method of generating ion pulses (sometimes referred to as ion "packets") from an ion beam.

BACKGROUND OF THE INVENTION

Time-of-flight mass spectrometers (TOFMS) are widely used to identify molecular structures in chemistry, bioscience, drug discovery and the like. The advantages of using TOFMS include its unlimited mass range, precise mass determination and the ability to detect transient signals.

For TOFMS analysis, ions are detected in the form of short bunches (or "packets") of several nanoseconds in duration. These short ion bunches are produced by either pulsed ion generation methods such as pulsed laser desorption/ionization (LDI) or by extracting them from an ion beam which is continuously generated. Electrospray (ES) and chemical ionization (CI) for instance, are continuous ionization techniques widely used for drug and biomolecule analysis. Continuous ionization by inductively coupled plasma (ICP) is an advanced technique for elemental analysis.

To produce ion packets from a continuous ion beam, a device as shown in FIG. 1 is usually utilized. That device (referred to as an ion pulser 16) normally consists of three or more parallel-arranged electrodes. One electrode R is a repeller electrode in the form of a solid metal plate, while the others such as $P_0$ and $P_1$ are ring-shaped electrodes with central openings each of typically 20 mm in diameter and each having a highly transparent metal mesh 24, 25 respectively (grid) covering the opening. The ion packet production occurs via two separated steps:

1. Ion filling period: A continuous ion beam 14 generated by an ion source 10 (which may be ES, CI, ICP or any other ion source generating a continuous beam) is directed into the region between a repeller electrode R and across grid 24 of electrode $P_0$ (which is parallel to electrode R) and is collected at a collector electrode (basically the same as electrode 146 shown in FIG. 4). The travel direction of ions is parallel to the electrodes. During this period, the voltages applied to repeller R and electrode $P_0$ are nearly the same, as indicated by pulse OFF regions 43 of a typical waveform 40 applied between R and $P_0$ (see FIG. 2A). This results in a time 46 during which ions can fill the region over grid 24 and continue to pass thereover for collection by a collection electrode beyond R and $P_0$ The filling time depends on the ion energy and mass of the ions to be analyzed and is generally of several hundred nanoseconds to several microseconds. By "filling time" in this context is referenced the time it takes to establish the beam containing the ions of highest predetermined mass of interest across grid 24.
2. When the region across grid 24 is filled with ions of interest, an electrical pulse (extraction pulse) 42 is applied to repeller R to form an accelerating field between R and $P_0$. Ions are bundled into a packet 28 and accelerated in the perpendicular direction of the original travel for provision to a mass analyzer section of a mass spectrometer. The duration 44 of the extraction pulse is determined by the time required to accelerate ions of all mass out of the ion pulser, i.e. to pass grid 24 and is generally 1 to 3 microseconds in a conventional TOFMS.

Steps 1 and 2 above are repeated during the entire sample analysis, and the repetition rate is dependent of the time for ions of maximum molecular weight of interest to reach a detector 180 of the mass analyzer. The flight time for the ions in the mass analyzer is a function of mass to charge ratio of ions and many other mechanical and electrical parameters as well. For a typical mass analyzer in ICP detection, the maximum flight time is about 40 $\mu$s.

In a conventional TOFMS, the extraction pulse is turned off after 1 to 3 $\mu$s and ions begin to refill the ion pulser. Up to the time the next extraction pulse is applied, there is a period that ions can "leak" from the ion pulser and be accelerated toward the detector. The leakage is a result of ion diffusion and space charge repulsion. Leakage ions 32 generate a continuous background noise in an acquired mass spectrum and limit signal-to-noise ratio, and hence the sensitivity of detection. That is, referring to FIG. 2B, ions continue to flow across grid 24 during pulse OFF times (which are relatively long compared to the ON times), and only that portion 58 of ions present just before application of pulse 42 is extracted. Ions during the time 54 of each pulse cycle have the potential of leaking into the analyzer region and increasing background noise.

U.S. Pat. No. 5,654,543 describes a method to reduced the above unwanted background noise by utilized an energy discrimination device. Using this method, unwanted species can be effectively blocked if they remain electrically charged. However, in many applications, large amounts of ions are sampled. These ions can become neutralized due to collisions with residual species in the vacuum chamber. Such neutral species retain the velocity of the ions and can reach the detector without being blocked by the energy discriminator. The resulting background noise originated from such neutral species has been experimentally observed (see P. Mahoney et al., *J Am Soc Mass Spectrom*, 8, 166–124 (1997).

It would be desirable then if a means could be found of reducing background noise resulting from the above described leakage ions. It would further be desirable if such a means was relatively simple to construct and use.

SUMMARY OF THE INVENTION

The present invention then, provides a method for reducing the above described background noise. In one aspect, the method provides an ion packet to an analyzer section of a mass spectrometer from an ion beam. A field pulse is applied to extract an ion packet from the beam at a sideways direction to the beam and provide it to a mass analyzer section of the mass spectrometer. This pulse simultaneously causes non-extracted ions of the beam to be deflected onto an electrode of opposite charge. A pulse ON time is at least twice as long (and optionally even three or four times as long) as required to extract the ion packet and provide it to the mass analyzer section, so as to reduce stray ions entering the mass analyzer section. In one aspect, a series of such pulses are applied as a pulse train such that during pulse ON times ion packets are extracted while other ions of the beam are deflected onto the second electrode.

In one aspect of the method, an ion beam is passed between first and second electrodes and across an opening in the second electrode. A potential difference pulse is applied across the electrodes such that during a pulse ON time, ions of the beam adjacent the opening just before the pulse is applied are extracted through the opening as an ion packet and provided to a mass analyzer section of the mass spectrometer, while other ions of the beam are caused to be deflected onto the second electrode which is oppositely charged from the ions. The pulse ON time may, for example, be at least twice as long as required to extract the ion packet so as to reduce stray ions entering the mass analyzer section. A series of such pulses may be applied as a pulse train such that during pulse OFF times the ion beam passes across the opening, and during pulse ON times ion packets are extracted while other ions of the beam are deflected onto the second electrode.

While various values of pulse ON time may be applied, the pulse ON time may be longer than the pulse OFF time. For example, pulse ON time may be at least twice as long (or four, or even ten times). In one embodiment, the pulse ON time is the time required for ions of a predetermined highest mass of interest to be analyzed by the analyzer section, minus the time required to refill the region of the beam from which the ion packet is extracted with ions of the predetermined highest mass (in some embodiments, the region across the opening). By "filling" or "refilling" the region in this context, is referenced that those ions of the predetermined mass have been re-established across the region from which the packets are extracted (in some embodiments, the region across the opening). The relative pulse ON and OFF times are optionally adjusted for the particular mass spectrometer to minimize background.

The present invention further provides a pulser in which one or more methods of the present invention can be executed, so as to provide an ion packet to an analyzer section of a mass spectrometer from an ion beam. The pulser includes a set of electrodes which can maintain an ion beam and to which a potential difference pulse can be applied to extract an ion packet from the beam at a sideways direction to the beam and provide it to a mass analyzer section of the mass spectrometer. The pulse simultaneously causes non-extracted ions of the beam to be deflected onto an electrode of opposite charge. A power supply provides the series of pulses as a pulse train to the electrode set, as described in the method above, so as to reduce stray ions entering the mass analyzer section.

In one aspect, the electrode set includes the first and second electrodes described above. Such electrodes may face one another with a gap between them which is narrower adjacent one side of the opening than at an opposite side of the opening, such that the ion beam can initially pass across the opening from the narrower side to the opposite side. In one configuration the first and second electrodes may be two parallel members with opposed inwardly directed extensions to define the narrower gap on the one side. The present invention further provides a mass spectrometer which includes the pulser and mass analyzer, of a configuration already described.

The various aspects of the present invention can provide any one or more of the following and/or other useful benefits. For example, by using an extraction pulse as described, the leakage of ions into the mass analyzer can be inhibited. As a result, noise at the detector can be reduced. Furthermore, the pulser may be of relatively simple construction.

BRIEF DESCRIPTION OF THE DRAWINGS

Embodiments of the invention will now be described with reference to the drawings, in which.

To facilitate understanding, identical reference numerals have been used, where practical, to designate identical elements that are common to the figures

DETAILED DESCRIPTION OF EMBODIMENTS OF THE INVENTION

In the present application, unless a contrary intention appears, the following terms refer to the indicated characteristics. Words such as "forward" are used in a relative sense only, generally with forward referring to a direction of ion flow. A "set" may have any number of multiple members (for example, two or more electrodes). Reference to a singular item, includes the possibility that there are plural of the same items present. Potentials are relative. All patents and other cited references are incorporated into this application by reference.

Figure 3:
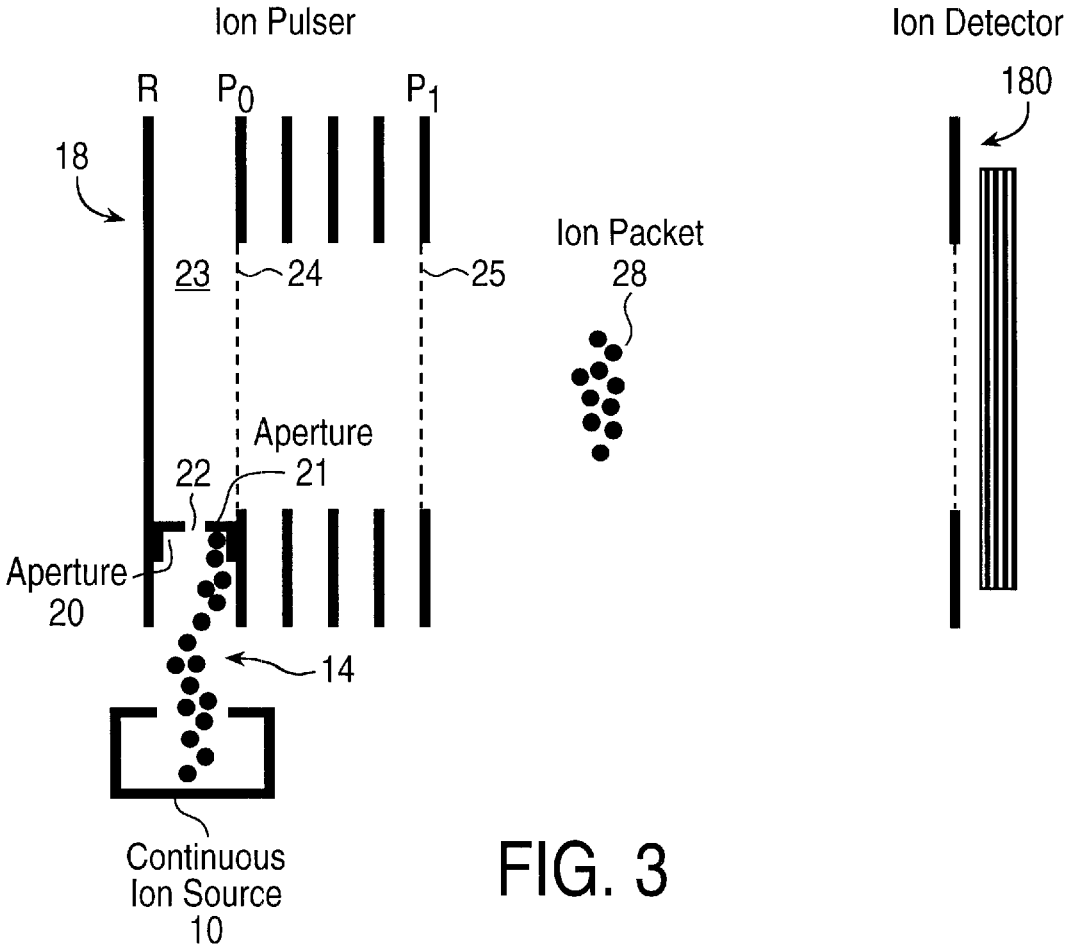
FIG. 3 is a pulser of the present invention.

Referring to FIG. 3, a pulser 18 of the present invention is illustrated. The set of parallel, facing electrodes R, $P_0$ are of the same construction as in the conventional pulser of FIG. 1 except as follows. In particular, the electrodes R, $P_0$ are provided with opposed inwardly directed extensions 20, 21, mechanically and electrically connected to the remainder of their respective electrodes, so as to define a gap therebetween in the form of aperture 22. Note that this gap, or aperture 22, is narrower adjacent one side of the opening defined by grid 24 than at the opposite side 23 of that opening. The width of aperture 22 can be chosen from 0.1 to 5 mm, but more typically from 0.2 mm to 3 mm. It will be appreciated though, that other less desirable arrangements could be used to establish this narrower gap.

Figure 4:
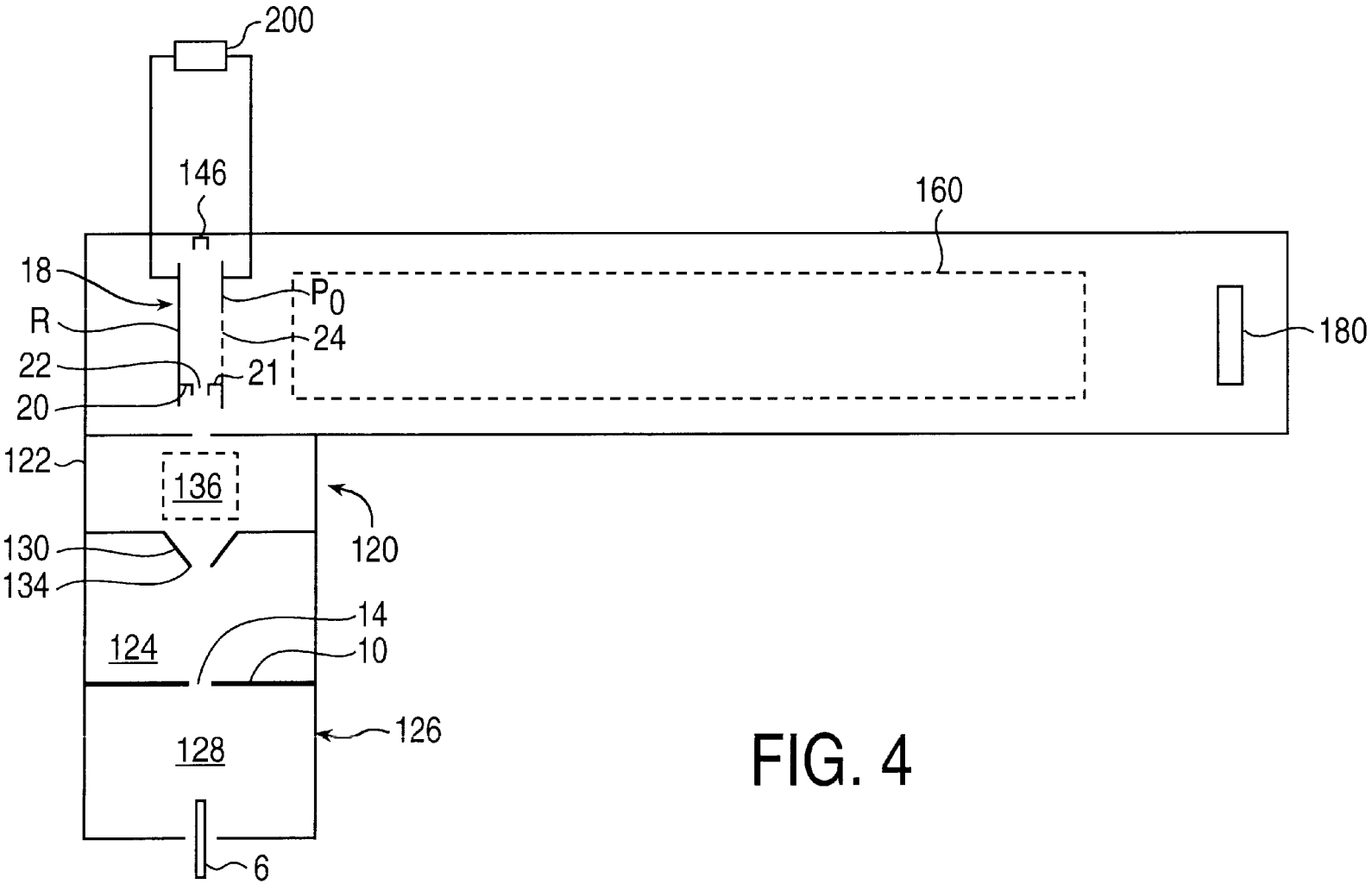
FIG. 4 is a mass spectrometer of the present invention which includes a pulser of the present invention.

The pulser 18 may be part of a conventional mass spectrometer such as a TOFMS illustrated schematically in FIG. 4. The illustrated mass spectrometer 120 includes a housing 122, a continuous ion source 6, and an interface member 10 in the form of a plate having an orifice 14. Downstream (used with reference to the normal direction of ion flow) from ion source 6 is provided a skimmer 130 with skimmer orifice 134, beam formation and guide section 136, the pulser 18, and an analyzer section 160 which includes detector 180. A power supply 200 is capable of providing the required series of potential difference pulses across electrodes R and $P_0$ as a waveform 40*a* shown in FIG. 5A. One or more pumps (not shown) are provided to maintain required pressures downstream of interface member 10. Components of such a mass spectrometer 120, other than pulser 18, and their operation, are well known and are described, for example, in U.S. Pat. No. 5,689,111 and the references cited herein, which are incorporated herein by reference. It will be appreciated though, that the present invention may be applied to any type of mass spectrometer where packets (or pulses) of ions are to be provided to the analyzer from an ion source that is continuous (or at least is more "continuous" than the required pulses, that is if it produces pulses then those are longer than needed to produce the required packets).

Figure 5:
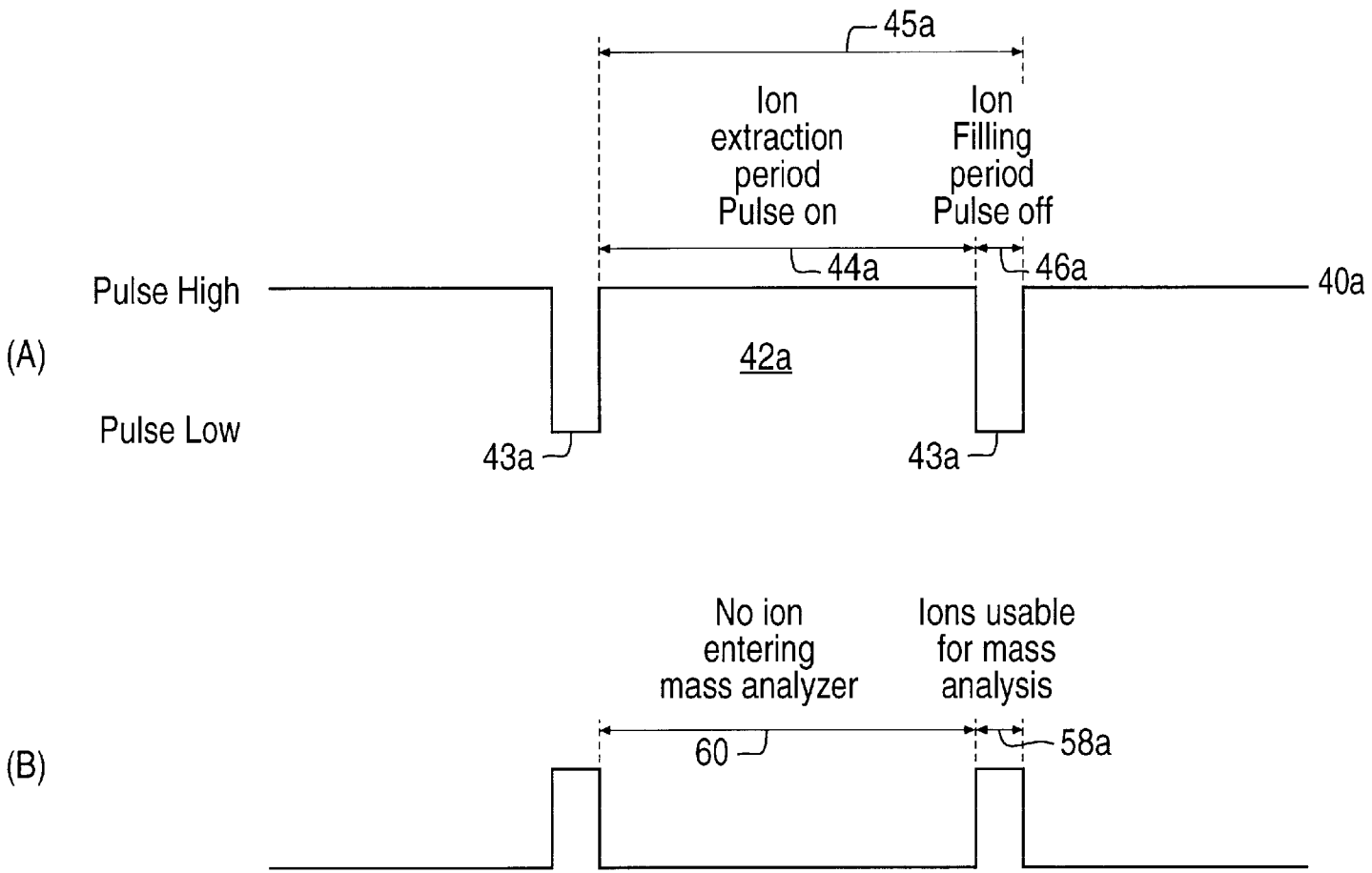
FIGS. 5 (A) and 5(B) is similar to FIGS. 2(A) and 2(B) are but illustrating the waveforms for operation of the pulser of FIG. 3.

In operation, pulser 18 receives an ion beam from ESI source 6 through orifices 14, 134 and beam formation and guide section 136, and pulser aperture 22. Power supply 200 provides the waveform 40*a* shown in FIG. 5A across electrodes R and $P_0$ at a pulse rate (frequency) based on the analyte being analyzed and the characteristics of analyzer section 160. For each cycle of waveform 40*a*, which corresponds to one analysis period 45*a*, during a pulse OFF time 43*a* (see FIG. 5A), which corresponds to the ion filling period, electrodes R and $P_0$ are held at the same potential. Thus, ion beam 14 passes between electrodes R and $P_0$, through aperture 22, across grid 24, and onto collection electrode 146. However, unlike a conventional pulser operation, only a very short OFF time 43*a* is provided, which is just a sufficient for the region across grid 24 to be filled. A voltage pulse is then applied across R and $P_0$, which, unlike a conventional operation of a pulser, has a pulse ON time 44*a* which is longer than the OFF time. Thus, as will be particularly seen from a comparison of FIGS. 2A and 5A, the waveform in FIG. 5A is essentially inverted from that of FIG. 2A as used in a conventional pulser. During pulse ON time electrode R is provided with a potential relative to electrode $P_0$ such that ions are repelled from electrode R. Specifically, where the ions of beam 14 are positive, electrode R will be of higher potential (more positive) than electrode $P_0$, while being of lower potential (more negative) where the ions of beam 14 are negative ions. The resulting electric field pulse will cause ion packet 28 to be extracted from the beam in a sideways direction (relative to the beam direction through pulser 18) through grid 24 and provided to mass analyzer section 160. Specifically, ion packet 28 is formed from those ions adjacent the opening defined by grid 24 just before the pulse is applied (which ions were filled during the preceding pulse OFF time 43*a* ).

During pulse ON time 44*a*, ions in beam 14 within pulser 18 which do not form ion packet 28 (in particular, ions which are not positioned across grid 24 just before pulse ON 44*a* is applied) will be deflected onto electrode $P_0$ which is oppositely charged from those ions (as will be appreciated, "oppositely charged" is relative to electrode R such that the ions are attracted to electrode $P_0$ ). That is, the continuous ion beam 14 is deflected toward, and discharged onto electrode $P_0$ before entering aperture 22. Thus, during pulse ON times after packet 28 has been extracted, essentially no stray ions can pass through grid 24 and enter the mass analyzer section 160 (as illustrated by time 60 in FIG. 5B). Only ions indicated at 58*a* in FIG. 5B which entered the pulser 18 during pulse OFF duration will be available for forming a packet 28.

Figure 2:
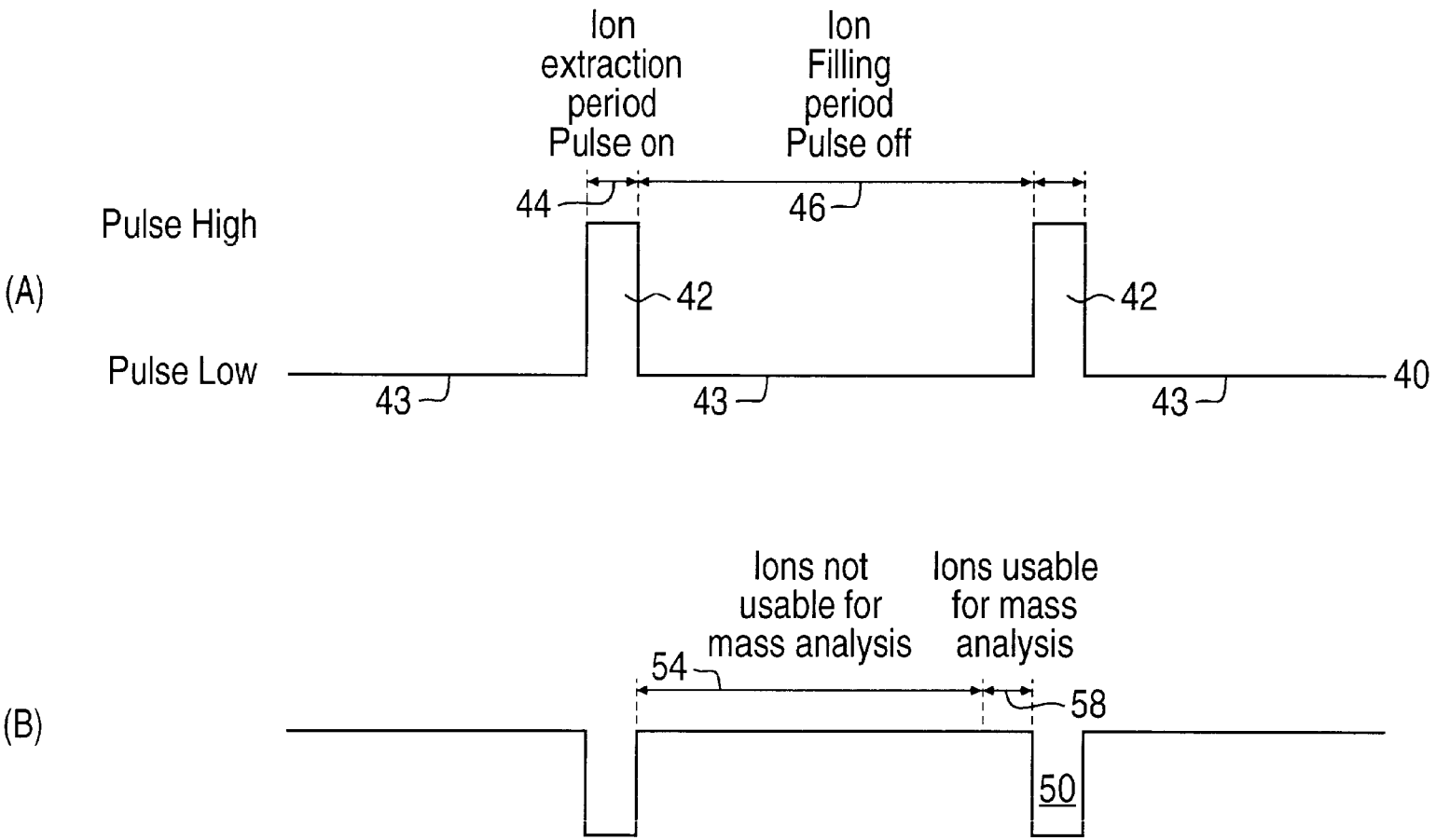
FIGS. 2(A) and 2(B) illustrate the voltage waveforms applied to a pulser of the construction of FIG. 1 (part A of the FIG.), and the ion current waveform through the pulser (see above discussion)

It will be seen then, that use of the foregoing method using a pulser waveform 40*a* (FIG. 5A) which is essentially inverted from a conventional waveform 40 (FIG. 2A). Such inverted extraction pulse inhibits leakage ions from entering mass analyzer 160, hence reduces the continuous background ions and neutral noise at detector 180. The particular construction with aperture 22 also helps to trap ions deflected onto electrode $P_0$ during pulse ON times.

The foregoing benefit can be better appreciated with reference to a conventional pulser operation. In particular, in a conventional pulser in a TOFMS instrument using an electrospray ion source 10, the time needed for accelerating ions to form ion packet 28 is about 1.4 $\mu$ under typical ion optical conditions such as the following:

Predetermined highest mass of interest=1000 amu

Acceleration Voltage (potential difference between R and $P_0$ during pulse ON) =1000 V Distance between the electrodes R and $P_0$:10 mm Therefore, in a conventional TOFMS, the pulse ON may only be approximately 2 $\mu$s. In a typical TOFMS instrument with 2 meters effective flight path and an ion energy of 5 keV, the analysis time for ion mass of 1000 amu is about 65 microseconds. During the pulse "off" period (63 $\mu$s), ions are able to continuously "leak" into the analyzer, resulting a continuous background noise. On the other hand, for a typical electrospray ion source with initial ion energy of 30 eV, the fill time is only 8 $\mu$s for a typical ion pulse with an extraction aperture (grid 24 diameter) of 20 mm. In the method of the present invention, the extraction pulse (pulse ON) may for example be 57 $\mu$s instead of 2 $\mu$s, with pulse OFF (filling time) about 8 or 10 $\mu$s. During this substantially longer pulse ON period of the present invention, ions cannot readily enter the mass analyzer. Continuous background ion noise may therefore be substantially reduced.

Figure 1:
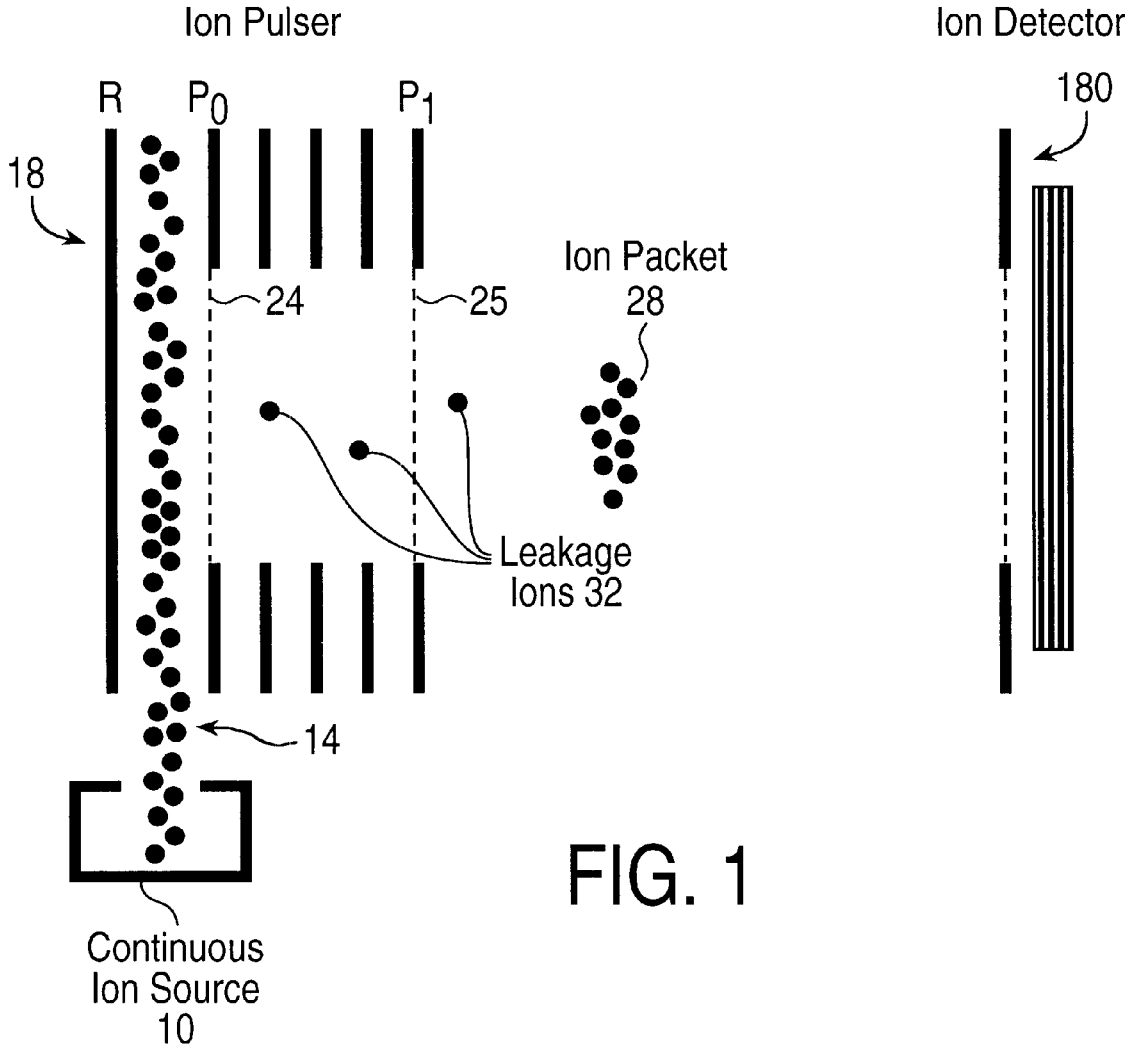
FIG. 1 is a prior art pulser (see above discussion)
Figure 6:
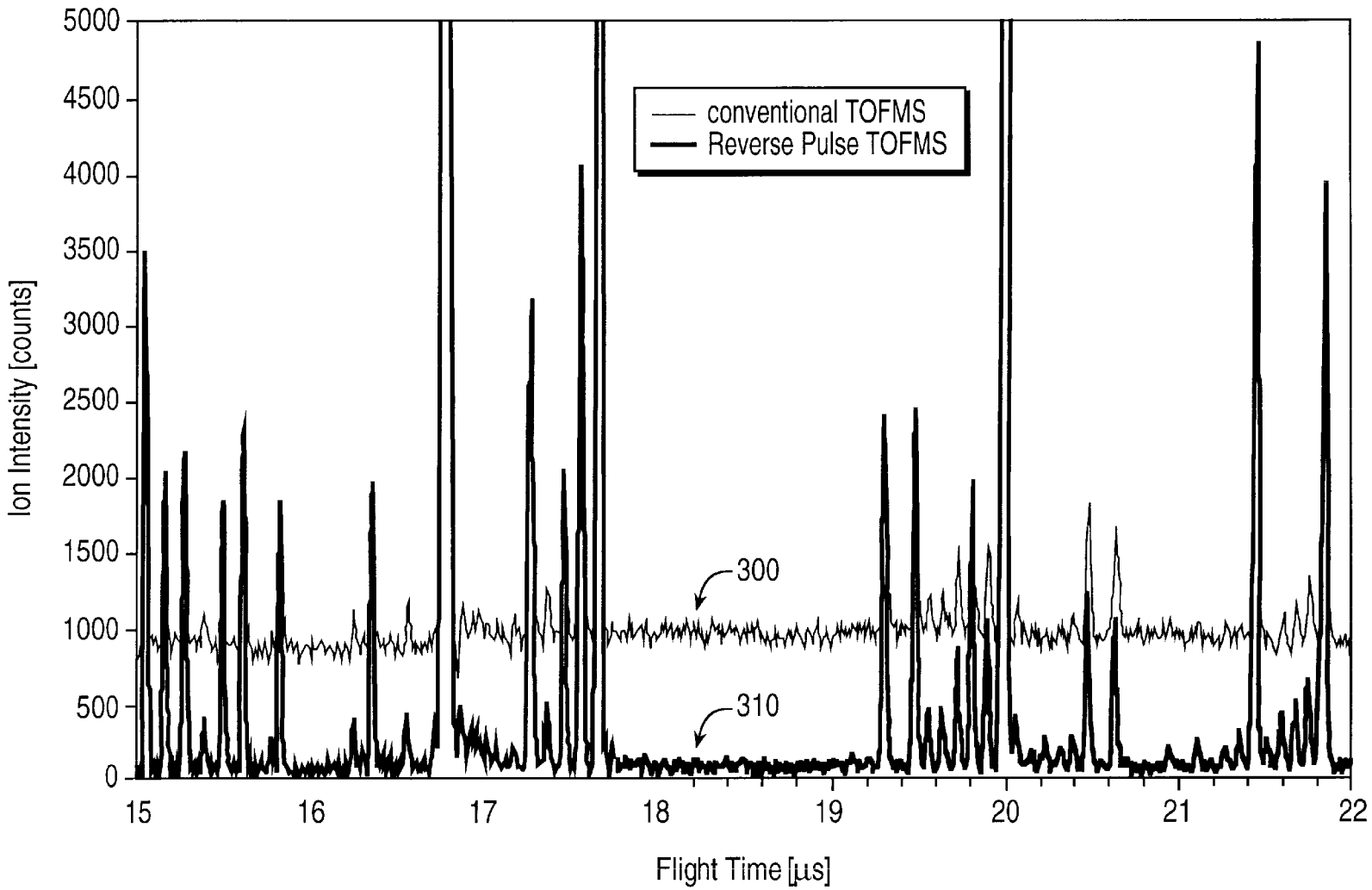
FIG. 6 illustrates detected signal using both the prior art pulser and method, and a pulser and method of the present invention.

A particular example of the present invention is illustrated in comparison to a conventional method. In particular, a multi-element analyte solution (2 ppb in concentration) was provided to an inductively couple plasma time-of-flight mass spectrometer (ICP-TOFMS) for a 10 second integrated detection time. The effective flight path of TOFMS and ion energy are 1 meter and 900 eV, respectively. It requires 36.4 $\mu$s for ions of highest mass, $^{238}$U in the sample, to reach the detector 180. On the other hand, only 1.8 $\mu$s is needed for accelerating ions out of the ion pulser 18, which is 10 mm in width (distance between R and $P_0$) using repeller pulse of 150 V. In one case, a conventional pulser as illustrated in FIG. 1 was used with a conventional waveform 40 illustrated in FIG. 2(A), the ion pulse was turned ON for 3 $\mu$s to ensure the ions of highest mass. i.e., $^{238U}$ were accelerated out of the ion pulser and then turned off for 37 $\mu$s during mass analysis. In another case, the same configuration was used but with an aperture 22 of 2 mm and with a waveform 40*a* (as shown in FIG. 5A) essentially inverted from waveform 40, that is, the extraction pulse was turned on for 36 $\mu$s to accelerate the ions adjacent the grid 24 out of the pulser and to deflect all the ions from entering the aperture 22. The ion pulse is then turned off for 4 $\mu$s to allow the ions of the highest mass, i.e. $^{238}$U to refill the ion pulser, or more precisely, to refill the space determined by the grid opening 24 which is 15 mm in diameter. The results of signal (ion intensity) detected, versus flight time of the detected species ($\mu$s) is illustrated in FIG. 6 in both cases. Detected signal 300 represents the result using the conventional pulser and method, while detected signal 310 represents detected signal using the pulser of FIG. 3 with the method of the present invention. As can be clearly seen from FIG. 6, noise is substantially reduced and real peaks of low signal can be more readily identified.

It will be appreciated that in the present invention, some benefit in terms of reduced leakage can be gained over conventional pulser operation where the pulse ON time is substantially greater than required to extract ion packet 28 (for example, at least 2, 4 or even 10 times longer, or with the pulse ON times longer than the pulse OFF times). However, it is preferred that the pulse ON time is the time required for ions of a predetermined highest mass of interest to be analyzed by the analyzer section 160, minus the time required to refill the 20 region of beam 14 from which the ion packet 28 is extracted (that is, the region across grid 24) with ions of the predetermined highest mass. This may be seen, for example, with reference to FIG. 5A, where the pulse ON time 44*a* is equal to the total analysis time 45*a* minus the pulse OFF time (ion filling period) 46*a*. With such a waveform ion leakage is kept to a minimum. The predetermined highest mass of interest may or may not correspond to the highest mass molecular species in the analyte. Also, as mentioned above the narrower gap on one side of grid 24 can be obtained by other means. For example, this can be obtained by making portions of electrodes R and $P_0$ non-parallel. Additionally, the opening in electrode $P_0$ as defined by grid 24, can be made smaller or larger (in fact, almost all of electrode P could be a grid, particularly where aperture 22 is closer to one edge of it than illustrated in FIG. 3). Thus, the opening in the electrode may be just the collective area of the gaps within the grid. Further, as mentioned above, the same pulser and methods can be applied to both of positive or negative ions, with the potential differences remaining the same (but with opposite signs).

Various further modifications to the particular embodiments described above are, of course, possible. Accordingly, the present invention is not limited to the particular embodiments described in detail above.

What is claimed is:

1. A method of providing an ion packet to an analyzer section of a mass spectrometer from an ion beam, comprising: applying a field pulse to extract an ion packet from a region of the beam at a sideways direction to the beam and provide said ion packet to a mass analyzer section of the mass spectrometer, which pulse simultaneously causes non-extracted ions of the beam to be deflected onto an electrode of opposite charge to said non-extracted ions; wherein a pulse ON time is at least twice as long as a pulse ON time required to extract the ion packet and provide said ion packet to the mass analyzer section, so as to reduce stray ions entering the mass analyzer section.

2. A method according to claim 1 wherein a series of the pulses are applied as a pulse train such that during pulse ON times ion packets are extracted while other ions of the beam are deflected onto said electrode of opposite charge.

3. A method according to claim 2 wherein the pulse ON times are longer than the pulse OFF times.

4. A method according to claim 2 wherein the pulse ON time is the time required for ions of a predetermined highest mass of interest to be analyzed by the analyzer section minus the time required to refill the region of the beam from which the ion packet is extracted with ions of the predetermined highest mass.

5. A method of providing an ion packet to an analyzer section of a mass spectrometer from an ion beam, comprising: (a) passing an ion beam between first and second electrodes and across an opening in the second electrode; and (b) applying a potential difference pulse across the electrodes such that during a pulse ON time, ions of a region of the beam adjacent the opening just before the pulse is applied are extracted through the opening as an ion packet and provided to a mass analyzer section of the mass spectrometer while other ions of the beam are caused to be deflected onto the second electrode which is oppositely charged from the ions; wherein the pulse ON time is at least twice as long as a pulse ON time required to extract the ion packet so as to reduce stray ions entering the mass analyzer section.

6. A method according to claim 5 wherein a series of pulses is applied as a pulse train such that during pulse OFF times the ion beam passes across the opening to a collection electrode, and during pulse ON times ion packets are extracted while other ions of the beam are deflected onto the second electrode.

7. A method according to claim 6 wherein the pulse ON time is longer than the pulse OFF time.

8. A method according to claim 7 wherein the pulse ON time is at least twice as long as the pulse OFF time.

9. A method according to claim 8 wherein the pulse ON time is at least four times as long as the pulse OFF time.

10. A method according to claim 6 additionally comprising adjusting the relative pulse ON and pulse OFF times.

11. A method according to claim 6 wherein the pulse ON time is the time required for ions of a predetermined highest mass of interest to be analyzed by the analyzer section minus the time required to refill the region of the beam across the opening with ions of the predetermined highest mass.

12. A pulser to provide an ion packet to an analyzer section of a mass spectrometer from an ion beam, comprising: (a) a set of electrodes which can maintain an ion beam and to which a potential difference pulse can be applied to extract an ion packet from the beam at a sideways direction to the beam and provide said ion packet to a mass analyzer section of the mass spectrometer, which pulse simultaneously causes non-extracted ions of the beam to be deflected onto an electrode of opposite charge; and (b) a power supply to provide a series of pulses as a pulse train to the electrode set, in which a pulse ON time of each cycle is longer than the pulse OFF time, so as to reduce stray ions entering the mass analyzer section.

13. A pulser according to claim 12 wherein: (i) the set of electrodes comprises first and second electrodes, the second electrode having an opening, such that: the ion beam can pass between the first and second electrodes and across the opening when the pulse is not applied; and during pulse ON times ions of the beam adjacent the opening just before the pulse is applied are extracted through the opening as ion packets for provision to a mass analyzer section of the mass spectrometer while other ions of the beam are caused to be deflected onto the second electrode which is oppositely charged from the ions; (ii) and wherein the power supply provides the pulse series with a pulse ON time of each cycle which is at least twice as long as a pulse ON time required to extract each ion packet through the opening so as to reduce stray ions entering the mass analyzer section.

14. A pulser according to claim 13 wherein the first and second electrodes face one another with a gap therebetween which is narrower adjacent one side of the opening than at an opposite side of the opening, such that the ion beam can initially pass across the opening from the narrower side to the opposite side.

15. A pulser according to claim 14 wherein the first and second electrodes comprise two parallel members with opposed inwardly directed extensions to define the narrower gap on the one side.

16. A pulser according to claim 13 wherein the pulse ON time is at least twice as long as the pulse OFF time.

17. A pulser according to claim 16 wherein the pulse ON time is at least four times as long as the pulse OFF time.

18. A mass spectrometer comprising: (a) an analyzer section; and (b) a pulser having: a set of electrodes which can maintain an ion beam and to which a potential difference pulse can be applied to extract an ion packet from the beam at a sideways direction to the beam and provide said ion packet to the mass analyzer section, which pulse simultaneously causes non-extracted ions of the beam to be deflected onto an electrode of opposite charge; and (c) a power supply to provide a series of pulses as a pulse train to the electrode set, in which a pulse ON time of each cycle is longer than the pulse OFF time, so as to reduce stray ions entering the mass analyzer section.

19. A mass spectrometer according to claim 18 wherein: (i) the electrode set comprises first and second electrodes, the second electrode having an opening, such that: the ion beam passes between the first and second electrodes and across the opening during pulse OFF times; and during pulse ON times ions of a region of the beam adjacent the opening just before each pulse is applied are extracted through the opening as ion packets for provision to a mass analyzer section of the mass spectrometer, while other ions of the beam are caused to be deflected onto the second electrode which is oppositely charged from the ions; and (ii) the power supply provides the pulse train with a pulse ON time of each cycle which is at least twice as long as pulse ON time required to extract each ion packet through the opening, so as to reduce stray ions entering the mass analyzer section.

20. A mass spectrometer according to claim 19 wherein the first and second electrodes face one another with a gap therebetween which is narrower adjacent one side of the opening than an opposite side of the opening, such that during pulse OFF times the ion beam initially passes across the opening from the narrower gap to the opposite side.

21. A mass spectrometer according to claim 20 wherein the first and second electrodes comprise two parallel members with opposed inwardly directed extensions which define the narrower gap on the one side.

22. A mass spectrometer according to claim 19 wherein the pulse ON time is at least twice as long as the pulse OFF time.

23. A mass spectrometer according to claim 19 wherein the pulse ON time is the time required for ions of a predetermined highest mass of interest to be analyzed by the analyzer section minus the time required to refill the region of the beam across the opening with ions of the predetermined highest mass.

* * * * *